US010299634B2

(12) United States Patent
Reyes

(10) Patent No.: US 10,299,634 B2
(45) Date of Patent: May 28, 2019

(54) HAIR CLIPPINGS COLLECTION SYSTEM

(71) Applicant: Clinton Reyes, Citrus Heights, CA (US)

(72) Inventor: Clinton Reyes, Citrus Heights, CA (US)

( * ) Notice: Subject to any disclaimer, the term of this patent is extended or adjusted under 35 U.S.C. 154(b) by 0 days.

(21) Appl. No.: 15/671,612

(22) Filed: Aug. 8, 2017

(65) Prior Publication Data

US 2019/0045979 A1 Feb. 14, 2019

(51) Int. Cl.
*E03C 1/186* (2019.01)
*A47K 1/06* (2006.01)

(52) U.S. Cl.
CPC ..... *A47K 1/06* (2013.01)

(58) Field of Classification Search
CPC ..... A47K 1/06
USPC ..... 4/657
See application file for complete search history.

(56) References Cited

U.S. PATENT DOCUMENTS

| | | | | |
|---|---|---|---|---|
| 2,817,851 | A | 12/1957 | Barnwell | |
| 5,911,941 | A | 11/1999 | Neal | |
| 5,991,942 | A * | 11/1999 | Neal | A47K 1/06 4/654 |
| D452,300 | S | 12/2001 | Jones | |
| 6,338,171 | B1 * | 1/2002 | Dandridge | A47J 47/20 4/657 |
| 7,685,654 | B1 | 3/2010 | Jones | |
| 9,080,322 | B1 * | 7/2015 | Rodrigues | A47K 1/06 |
| D762,828 | S * | 8/2016 | Nolen | D23/308 |
| 9,493,934 | B2 * | 11/2016 | Clayton | E03C 1/186 |
| 2007/0180610 | A1 | 8/2007 | Mohr et al. | |
| 2010/0325791 | A1 | 12/2010 | Davidowitz | |
| 2013/0019397 | A1 | 1/2013 | May | |
| 2016/0331188 | A1 * | 11/2016 | Bevill | A47K 1/06 |
| 2018/0035847 | A1 * | 2/2018 | Purvis | A45D 27/00 |

* cited by examiner

*Primary Examiner* — Huyen Le

(57) ABSTRACT

A hair clippings collection system for collecting hair clippings includes a sink that may be manipulated in the convention of plumbed sinks. A shroud is selectively draped over the sink to capture hair clippings from shaving or the like. In this way the shroud inhibits the sink from being contaminated with the hair clippings. A pocket is coupled to the shroud to contain objects.

6 Claims, 2 Drawing Sheets

HAIR CLIPPINGS COLLECTION SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to collection devices and more particularly pertains to a new collection device for collecting hair clippings.

BRIEF SUMMARY OF THE INVENTION

An embodiment of the disclosure meets the needs presented above by generally comprising a sink that may be manipulated in the convention of plumbed sinks. A shroud is selectively draped over the sink to capture hair clippings from shaving or the like. In this way the shroud inhibits the sink from being contaminated with the hair clippings. A pocket is coupled to the shroud to contain objects.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
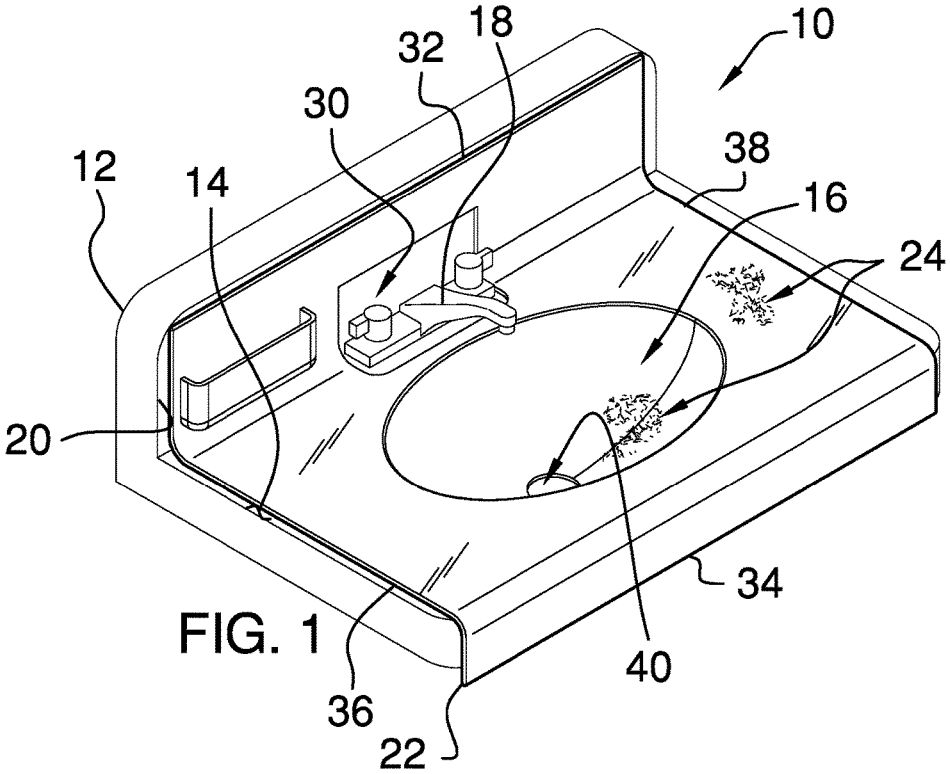
FIG. 1 is a top perspective view of a hair clippings collection system according to an embodiment of the disclosure.
Figure 2:
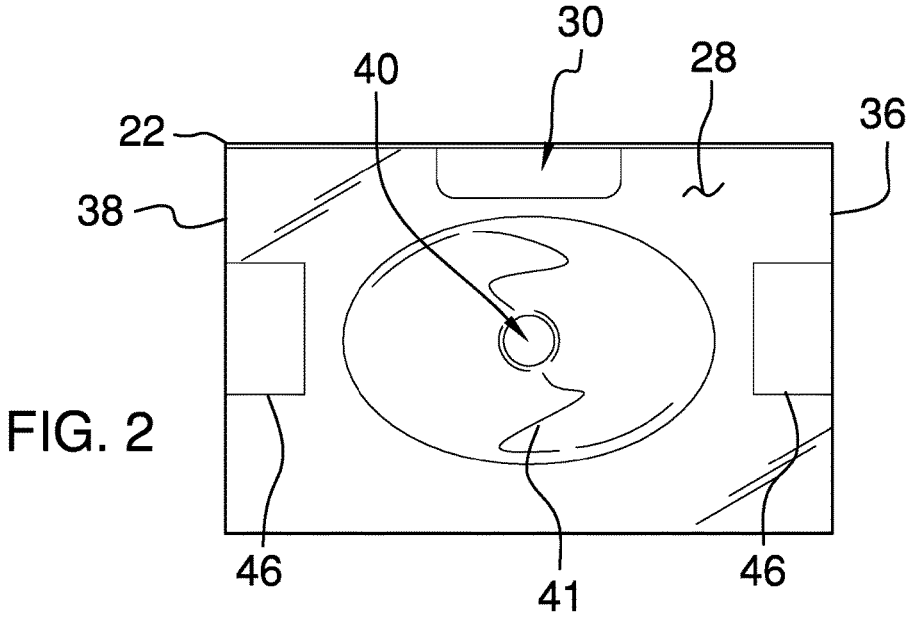
FIG. 2 is a bottom view of a shroud of an embodiment of the disclosure.
Figure 3:
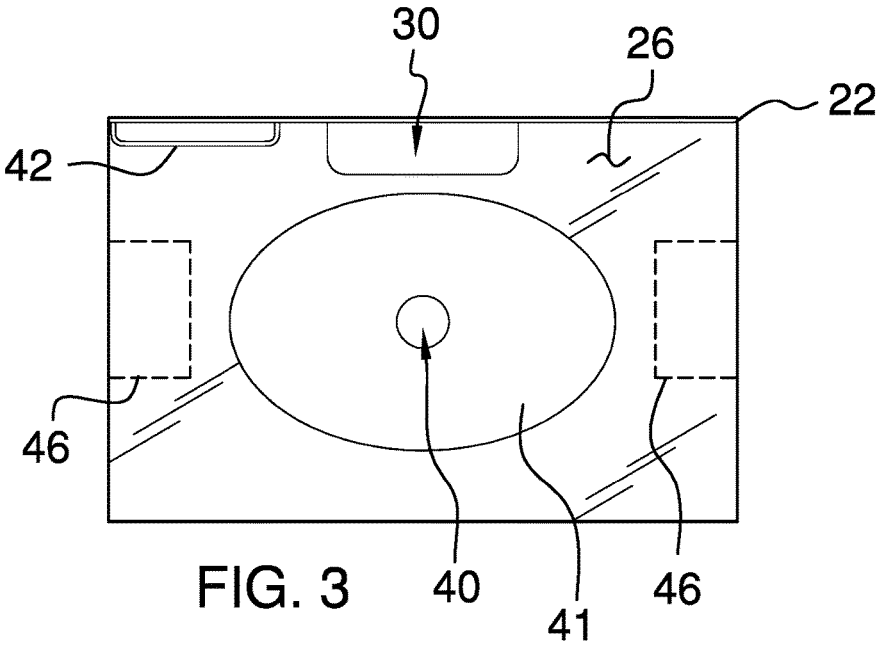
FIG. 3 is a top view of a shroud of an embodiment of the disclosure.
Figure 4:
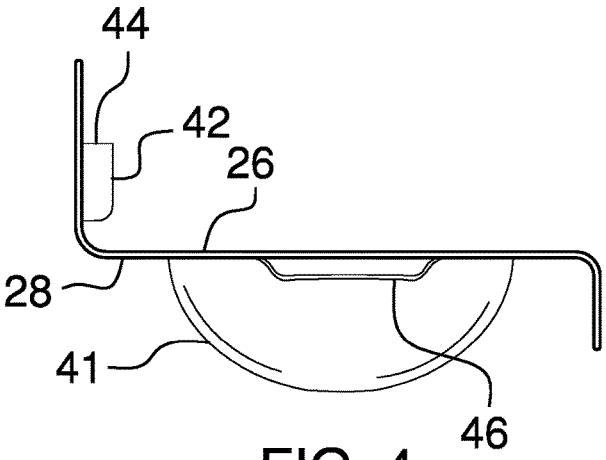
FIG. 4 is a right side view of shroud of an embodiment of the disclosure.

With reference now to the drawings, and in particular to FIGS. 1 through 4 thereof, a new collection device embodying the principles and concepts of an embodiment of the disclosure and generally designated by the reference numeral 10 will be described.

As best illustrated in FIGS. 1 through 4, the hair clippings collection system 10 generally comprises a sink 12 that may be manipulated in the convention of plumbed sinks. The sink 12 may be a bathroom vanity or the like. The sink 12 has a top surface 14, a basin 16, a faucet 18 and a back splash 20.

A shroud 22 is provided and the shroud 22 is selectively draped over the sink 12. The shroud 22 is configured to capture hair clippings 24 from shaving or the like thereby inhibiting the sink 12 from being contaminated with the hair clippings 24. The shroud 22 may be comprised of a fluid impermeable material and the shroud 22 has a first surface 26 and a second surface 28. The first surface 26 lies on the top surface 14 of the sink 12 when the shroud 22 is draped over the sink 12.

The shroud 22 has a first opening 30 extending through the first surface 26 and the second surface 28. The first opening 30 is aligned with the faucet 18 when the shroud 22 is draped over the sink 12. In this way the faucet 18 is accessible when the shroud 22 is positioned on the sink 12. The shroud 22 has a top edge 32, a bottom edge 34, a first lateral edge 36 and a second lateral edge 38. The first opening 30 may be positioned closer to the top edge 32 than the bottom edge 34.

The shroud 22 has a second opening 40 extending through the first surface 26 and the second surface 28. The second opening 40 is aligned with the basin 16 when the shroud 22 is draped over the sink 12. In this way the basin 16 is accessible when the shroud 22 is positioned on the sink 12. The second opening 40 may have a variety of shapes to accommodate a variety of basin 16 shapes. Moreover, the second opening 40 may be positioned between the first opening 30 and the bottom edge 34 of shroud 22.

The shroud 22 has a bowl portion 41 and the bowl portion 41 extends downwardly from the first surface 26. The bowl portion 41 is concavely arcuate with respect to the second surface 28 and the bowl portion 41 is centrally positioned on the shroud 22. The bowl portion 41 lies on the basin 16 when the shroud 22 is positioned on the sink 12.

A pocket 42 is coupled to the shroud 22 to contain objects. The pocket 42 has a top side 44 and the top side 44 is open. Thus, the top side 44 receives the objects. The pocket 42 is positioned on the second surface 28 and the pocket 42 may be positioned between the first opening 30 and the first lateral edge 36 of the shroud 22.

A pair of compartments 46 is provided and each of the compartments 46 is coupled to the first surface 26 of the shroud 22. Each of the compartments 46 may be aligned with an associated one of the first lateral edge 36 and the second lateral edge 38 of the shroud 22. Each of the compartments 46 may contain objects.

In use, the shroud 22 is positioned on the sink 12 when the sink 12 is used to capture the hair clippings 24. The shroud 22 covers the back splash 20 and the top surface 14 of the sink 12 when the shroud 22 is positioned on the sink 12. The first opening 30 is aligned with the faucet 18 and the bowl portion 41 is positioned to cover to basin 16. The second opening 40 is aligned with a drain in the basin 16. The hair clippings 24 fall onto the shroud 22 thereby inhibiting the hair clippings 24 from contaminating the sink 12. The shroud 22 is laundered when the shroud 22 is covered with the hair clippings 24.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hair clippings collection system comprising:

a sink, said sink having a top surface, a basin and a faucet;

a shroud being selectively draped over said sink wherein said shroud is configured to capture hair clippings from shaving or the like thereby inhibiting the sink from being contaminated with the hair clippings, said shroud having a first surface and a second surface, said first surface lying on said top surface of said sink when said shroud is draped over said sink, said shroud having a bowl portion, said bowl portion extending downwardly from said first surface, said bowl portion being centrally positioned on said shroud, said bowl portion lying on said basin when said shroud is positioned on said sink; and a pocket being coupled to said shroud wherein said pocket is configured to contain objects.

2. The system according to claim 1, wherein said shroud has a first opening extending through said first surface and said second surface, said first opening being aligned with said faucet when said shroud is draped over said sink wherein said faucet is configured to be accessible.

3. The system according to claim 1, wherein said shroud has a second opening extending through said first surface and said second surface, said second opening being aligned with said basin when said shroud is draped over said sink wherein said basin is configured to be accessible.

4. The system according to claim 3, wherein said second opening is centrally positioned on said bowl portion.

5. The system according to claim 1, wherein said pocket has a top side, said top side being open wherein said top side is configured to receive the objects, said pocket being positioned on said second surface.

6. A hair clippings collection system comprising:

a sink being configured to be manipulated in the convention of plumbed sinks, said sink having a top surface, a basin and a faucet;

a shroud being selectively draped over said sink wherein said shroud is configured to capture hair clippings from shaving or the like thereby inhibiting the sink from being contaminated with the hair clippings, said shroud having a first surface and a second surface, said first surface lying on said top surface of said sink when said shroud is draped over said sink, said shroud having a first opening extending through said first surface and said second surface, said first opening being aligned with said faucet when said shroud is draped over said sink wherein said faucet is configured to be accessible, said shroud having a second opening extending through said first surface and said second surface, said second opening being aligned with said basin when said shroud is draped over said sink wherein said basin is configured to be accessible, said shroud having a bowl portion, said bowl portion extending downwardly from said first surface, said bowl portion being centrally positioned on said shroud, said bowl portion lying on said basin when said shroud is positioned on said sink, said second opening being centrally positioned on said bowl portion; and a pocket being coupled to said shroud wherein said pocket is configured to contain objects, said pocket having a top side, said top side being open wherein said top side is configured to receive the objects, said pocket being positioned on said second surface.

* * * * *